US011424544B1

(12) United States Patent
Rivera

(10) Patent No.: US 11,424,544 B1
(45) Date of Patent: Aug. 23, 2022

(54) BENT PLATE ANTENNA

(71) Applicant: The United States of America as represented by the Secretary of the Navy, Newport, RI (US)

(72) Inventor: David F Rivera, Westerly, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 17/381,227

(22) Filed: Jul. 21, 2021

(51) Int. Cl.

| | |
|---|---|
| ***H01Q 9/46*** | (2006.01) |
| ***H01Q 1/12*** | (2006.01) |
| ***H01Q 1/38*** | (2006.01) |
| ***H01Q 9/42*** | (2006.01) |

(52) U.S. Cl.
CPC ..... *H01Q 9/46* (2013.01); *H01Q 1/12* (2013.01); *H01Q 1/38* (2013.01); *H01Q 9/42* (2013.01)

(58) Field of Classification Search
CPC ..... H01Q 1/12; H01Q 1/1221; H01Q 1/38; H01Q 5/357; H01Q 5/364; H01Q 5/371; H01Q 9/40; H01Q 9/42; H01Q 9/46
See application file for complete search history.

(56) References Cited

U.S. PATENT DOCUMENTS

| | | | | |
|---|---|---|---|---|
| 2006/0071871 | A1* | 4/2006 | Tang | H01Q 9/40 343/826 |
| 2017/0069974 | A1* | 3/2017 | Shamblin | H01Q 1/48 |
| 2020/0411985 | A1* | 12/2020 | Sun | H01Q 5/25 |

* cited by examiner

*Primary Examiner* — Robert Karacsony
(74) *Attorney, Agent, or Firm* — James M. Kasischke; Michael P. Stanley

(57) ABSTRACT

An antenna is provided which includes a base piece, a first arm, and a second arm. The first arm includes a first section extending vertically from the base piece. The first arm also includes a second section connected to the first section. The second section vertically extends orthogonal from the first section. The first arm further includes a third section extending linearly from the second section. The third section is bent at an angle out of the vertical plane. The second arm includes a first section vertically extending from the base piece. The second arm also includes a second section connected to the first section. The second section angularly extends from the first section in the vertical plane. The second arm further includes a third section extending linearly from the second section. The third section is bent at an angle out of the vertical plane.

12 Claims, 4 Drawing Sheets

BENT PLATE ANTENNA

STATEMENT OF GOVERNMENT INTEREST

The invention described herein was made in the performance of official duties by employees of the U.S. Department of the Navy and may be manufactured, used, or licensed by or for the Government of the United States for any governmental purpose without payment of any royalties thereon.

CROSS REFERENCE TO OTHER PATENT APPLICATIONS

None.

BACKGROUND OF THE INVENTION

1) Field of the Invention

The present invention is directed to antennas and more particularly to an antenna having bent plates that enable operation of the antenna over a wide frequency bandwidth.

2) Description of the Prior Art

An antenna may be used for transmission of a signal, in which radio-frequency electrical energy from a transmitter is converted to electromagnetic energy and radiates into the surrounding environment for reception of a signal. Electromagnetic energy impinging on the antenna converts into radio-frequency electrical energy and is fed to a receiver. The frequency bandwidth depends on the size and design for a particular frequency while reception and transmission signal strength depends on the orientation of the antenna with respect to a signal path.

Antennas that operate efficiently over a wide frequency bandwidth and have a beam pattern to permit reception and transmission of signals over a substantial portion of the space above are highly desirable.

SUMMARY OF THE INVENTION

The bent plate antenna of the present invention includes a surface mounting base having a horizontal or flat portion and a vertical portion. The vertical portion is perpendicular to the flat portion to define a vertical plane. A planar face of a base piece attaches to the vertical plane with the base plate integral to a first arm and a second arm collinear to the base plate.

The first arm includes a first section extending from the base piece in the vertical plane. The first section has a proximal end connected to the base piece and a distal end. The first arm also includes a second section having a proximal end connected to the distal end of the first section. The second section extends orthogonal from the distal end of the first section in the vertical plane. The first arm also includes a third section extending linearly from a distal end of the second section. The third section is bent at an angle out of the vertical plane.

The second arm includes a first section extending from the base piece in the vertical plane. The first section has a proximal end connected to the base piece and a distal end. The second arm also includes a second section having a proximal end connected to the distal end of the first section and extends angularly from the distal end of the first section in the vertical plane. The second arm further includes a third section extending linearly from the distal end of the second piece. The third section is bent at an angle out of the vertical plane.

A connector port is fastened to the mounting base. A stem connects the base piece to the connector port.

The antenna of the present invention operates over a nominal bandwidth of plus or minus twenty-three percent from a center design-frequency and is not impacted by de-tuning issues. The antenna is shaped and sized to radiate or receive signals over a large hemispherical portion of space. The antenna maintains the hemispherical beam pattern characteristic over a wide band of frequencies with an electrical match to a 50-ohm receiver or transmitter.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
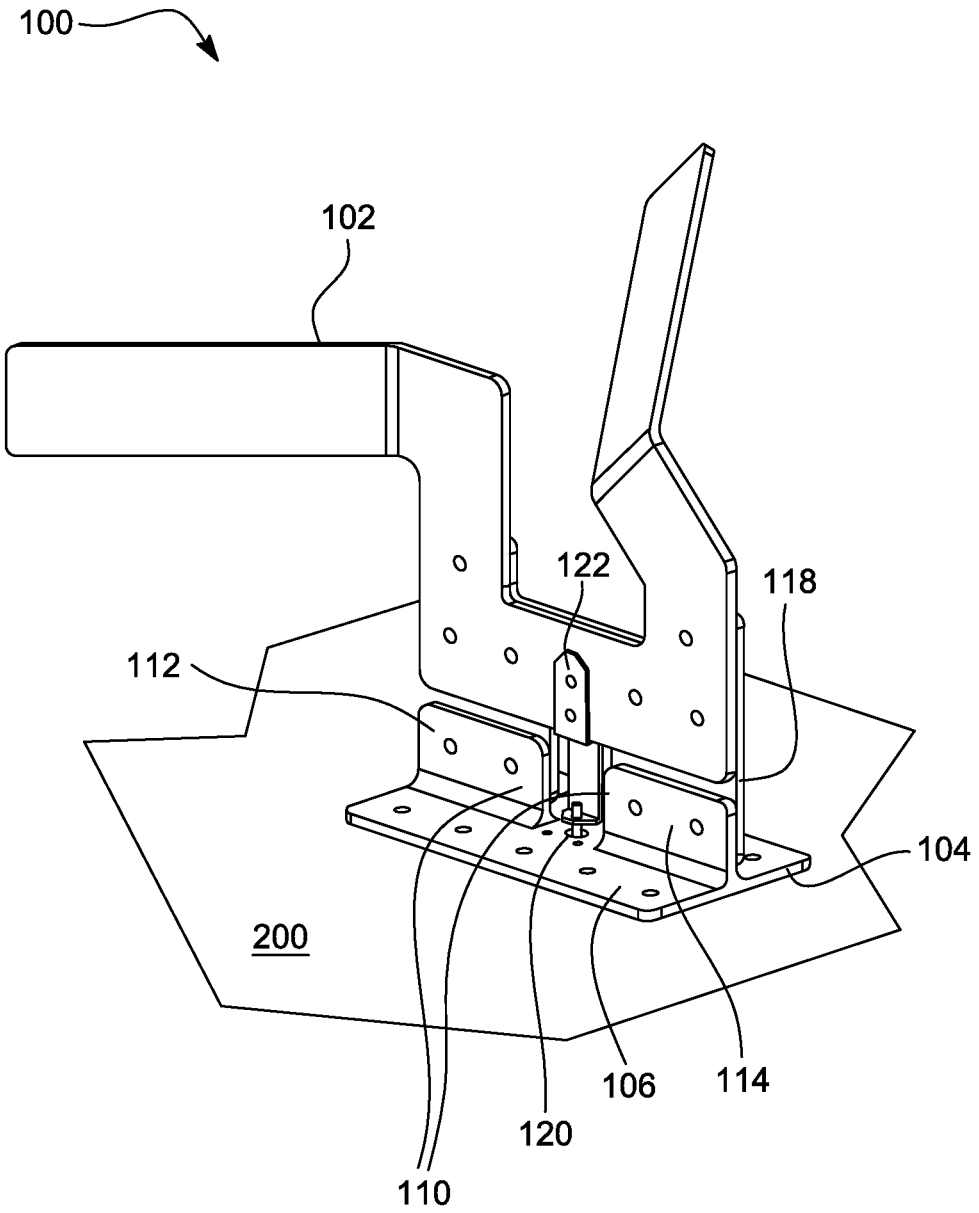
FIG. 1 is a perspective view of an antenna of the present invention.

Referring to the drawings, FIG. 1 depicts an antenna 100. The antenna 100 includes a metal sheet 102 bent and shaped as described in further detail below. The antenna 100 has a surface mounting base 104 with a flat portion 106 fastened to a ground plane 200. The ground plane 200 is usually a metal ground plane, but may be water, such as seawater, or another surface.

The mounting base 104 also has a vertical portion 110. The vertical portion 110 defines a vertical plane perpendicular to the ground plane 200. The vertical portion 110 is divided into a first section 112 and a second section 114. Each of the sections 112, 114 is in the same vertical plane. A gap is located between the sections 112, 114. The vertical portion 110 fastens to the metal sheet 102.

An insulating support 118 is provided between the metal sheet 102 and the vertical portion 110. The insulating support 118 may be made of a polymer (e.g., Delrin). A connector port 120 is fastened to the mounting base 104 between the first section 112 and the second section 114. Typically, the connector port 120 is a coaxial connector with an insulated center pin connected to a signal receiver, as would be known by one of ordinary skill in the art. A stem 122 connects the metal sheet 102 to the connector port 120. The stem 122 may be made of metal or other conductive material.

Figure 2:
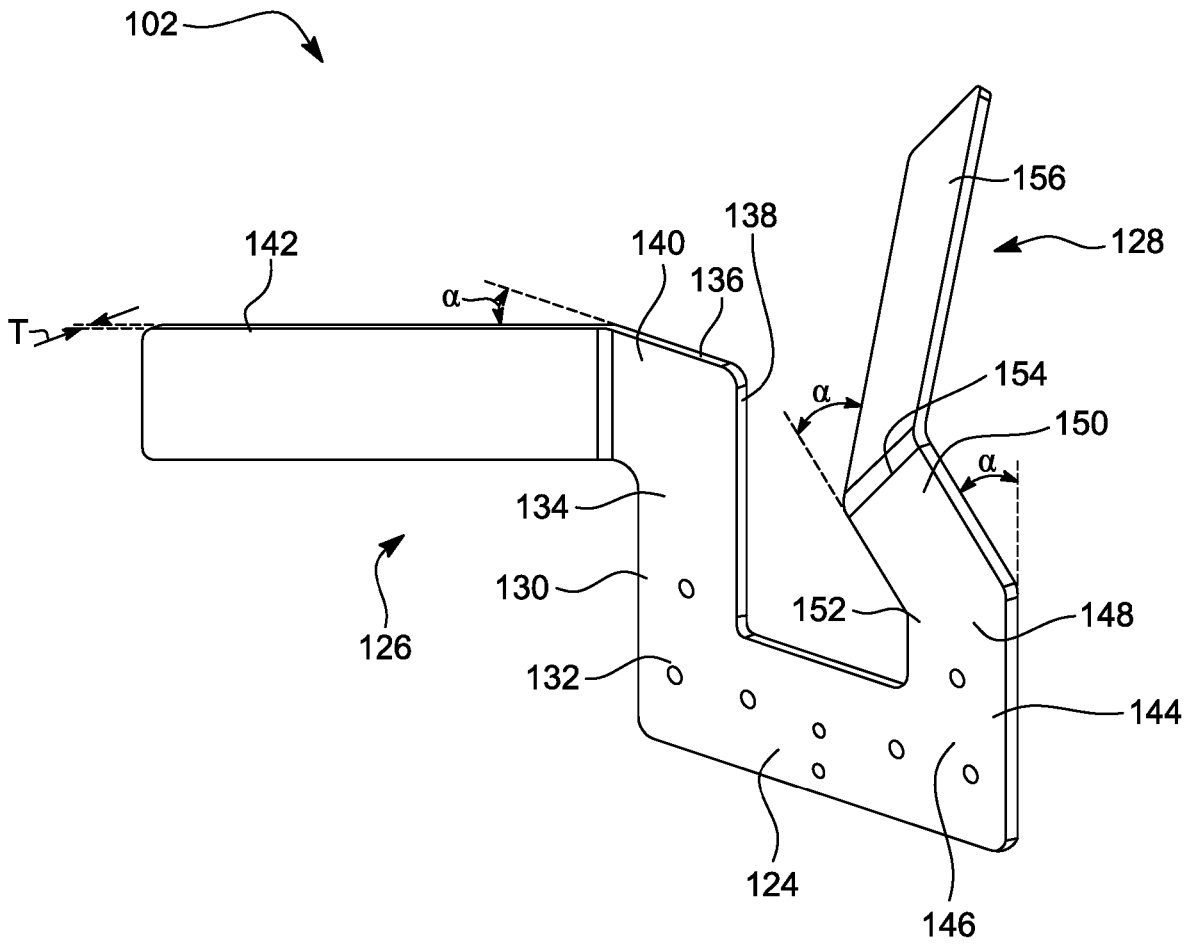
FIG. 2 is a perspective view of a bent plate used in the antenna.

FIG. 2 depicts the formed metal sheet 102 used in the antenna 100 of the present invention. The metal sheet 102 includes a base piece 124, a first arm 126, and a second arm 128. The base piece 124 is located in the vertical plane defined by the vertical portion 110 of the mounting base 104, shown in FIG. 1. The first arm 126 includes a first section 130 extending perpendicular from the base piece 124 in the vertical plane. The first section 130 has a proximal end 132 connected to the base piece 124 and a distal end 134.

The first arm 126 further includes a second section 136 having a proximal end 138 connected to the distal end 134 of the first section 130 and a distal end 140. The second section 136 extends orthogonal from the distal end 134 of the first section 130 in the same vertical plane as the first section 130 and the base piece 124. The first arm 126 further includes a third section 142 extending linearly from the distal end 140 of the second section 136. The third section 142 is bent at an angle out of the vertical plane.

The second arm 128 includes a first section 144 extending perpendicular from the base piece 124 in the vertical plane. The first section 144 has a proximal end 146 connected to the base piece 124 and a distal end 148. The second arm 128 also includes a second section 150 having a proximal end 152 connected to the distal end 148 of the first section 144 and a distal end 154. The second section 150 extends at an angle from the distal end 148 of the first section 144 in the same vertical plane as the first section 144 and the base piece 124. The second arm 128 further includes a third section 156 extending linearly from the distal end 154 of the second section 150. The third section 156 is bent at an angle out of the vertical plane. As shown in FIG. 2, the first arm 126 and the second arm 128 are bent at the same angle in opposite directions out of the vertical plane.

Figure 3:
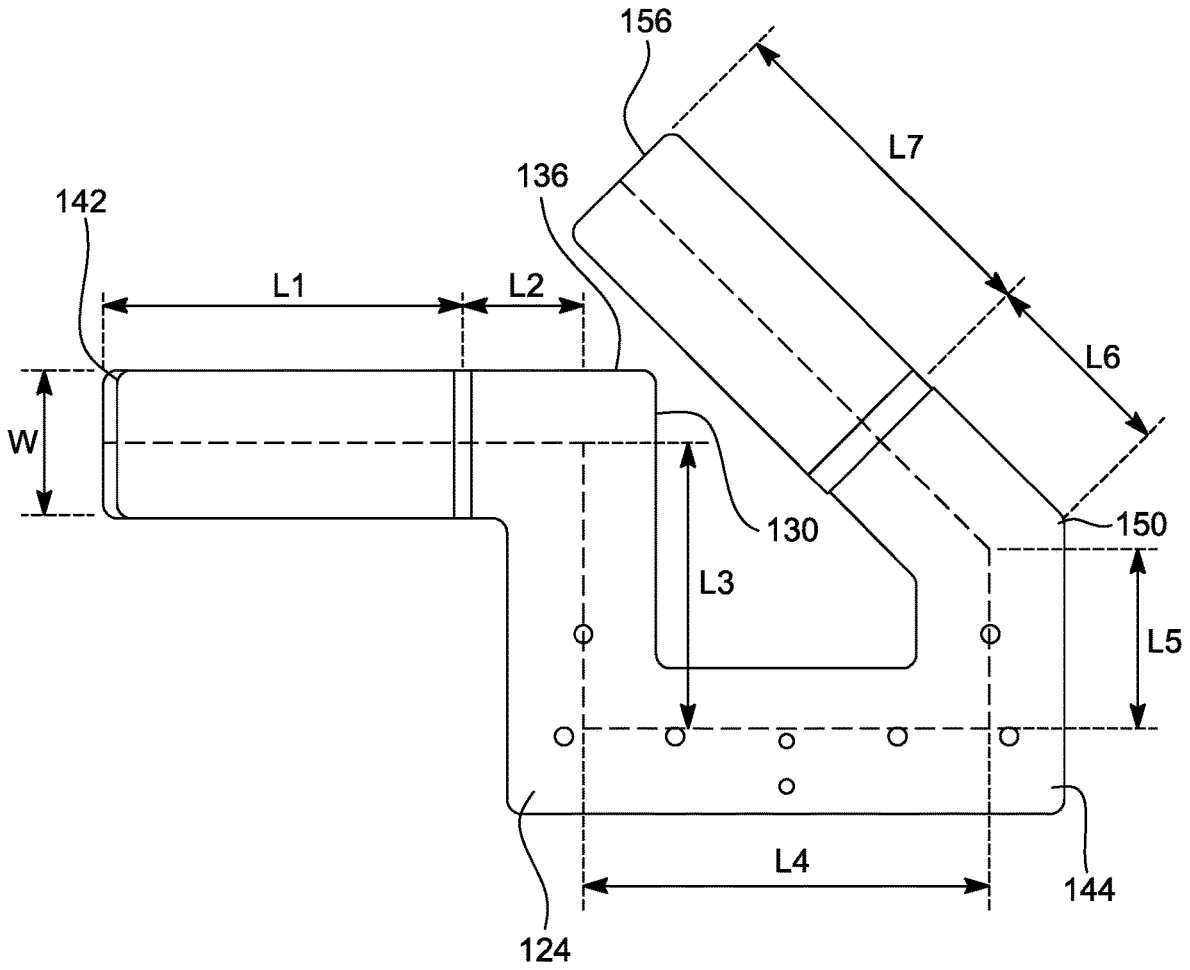
FIG. 3 is a front view of the bent plate with dimensions.
Figure 4:
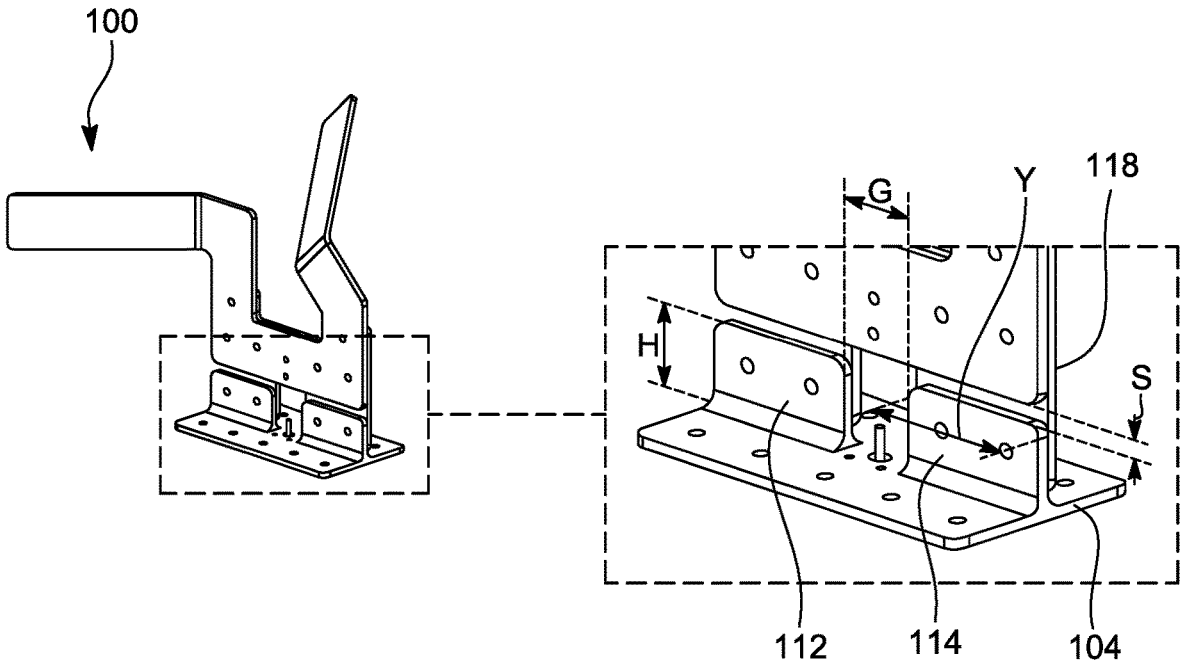
FIG. 4 is an enlarged view of a portion of the antenna with dimensions.

Referring to FIG. 3 and FIG. 4 the physical dimensions of the antenna 100 are determined at a desired center design frequency $f_0$ (in Hertz, Hz), followed by calculation of the corresponding wavelength $\lambda_0$ by Equation (1):

$$\lambda_o = \frac{\upsilon_o}{f_o} \tag{1}$$

where $\upsilon_0$ is the speed of light ($\approx 3\times10^8$ meters/sec).

Once the wavelength $\lambda_0$ is calculated, dimensions for the various sections of the antenna 100 are determined such that the realized power gain of the antenna 100 is at maximum. Table 1 lists empirically derived nominal antenna dimensions for maximum gain at the center design frequency.

TABLE 1

| Symbol | Description | Dimension |
|---|---|---|
| L1 | third section 142 of first arm 126 | 0.22 $\lambda_0$ |
| L2 | second section 136 of first arm 126 | 0.05 $\lambda_0$ |
| L3 | first section 130 of first arm 126 | 0.14 $\lambda_0$ |
| L4 | base piece 124 | 0.19 $\lambda_0$ |
| L5 | first section 144 of second arm 128 | 0.17 $\lambda_0$ |
| L6 | second section 150 of second arm 128 | 0.08 $\lambda_0$ |
| L7 | third section 156 of second arm 128 | 0.22 $\lambda_0$ |
| W | width of metal sheet 102 | 0.07 $\lambda_0$ |
| T | thickness of metal sheet 102 | 0.005 $\lambda_0$ |
| α | bend angle(s) | 45° |
| S | spacing between metal sheet 102 and vertical portion 110 of mounting base 104 | 0.01 $\lambda_0$ |
| G | gap | 0.05 $\lambda_0$ |
| H | vertical portion 110 of mounting base 104 | 0.05 $\lambda_0$ |
| Y | section 112, 114 of vertical portion 110 of mounting base 104 | 0.05 $\lambda_0$ |

The antenna dimensions listed in Table 1 yield peak power gain at the center of the selected design frequency. The gain falls away from a peak value at rates dependent on the electrical conductivity and size of the ground plane 200. For a finite-size metal ground plane, the normalized gain reaches one-half (or 3-dB down) of a maximum value at a frequency deviation of about 23.5% from the center design frequency, while for a seawater ground plane; the deviation is somewhat asymmetrical, being approximately 24% below and approximately 29% above the center design frequency.

The radiation beam patterns of the antenna are generated by the vector surface current distribution on the first arm 126 and the second arm 128 as well as the ground plane 200. The magnitude and phase of the current along the first arm 126 and the second arm 128 are controlled by the electromagnetic coupling from arm-to-arm and from arm-to-ground, as set by the spatial arrangement. For a given ground plane size, the pattern shape is stable with variation in frequency and with satisfactory levels (greater than 0 dBi).

The antenna beam pattern when mounted on a ground plane of finite-extent will change from that of the infinite-extent case because a fraction of the vector surface currents induced on the ground plane (as generated by the antenna) propagate toward the edges with an amplitude that varies inversely with the electrical size of the ground plane. An abrupt discontinuity is presented by these edges to those propagating currents, which in turn generate a secondary radiative source, sometimes referred to as a Huygens source, having an amplitude and phase that depends on the ground plane shape and its electrical size.

The antenna 100 of the present invention is useful in maritime satellite communications. The pattern of the antenna over seawater is similar to the infinitely large metal ground plane case, except near the horizon (90° and 270°) where the pattern tucks inward due to the interaction between the direct ray from the antenna and the reflected ray from the sea. As the elevation angle approaches 90° (and 270°); the vector sum of the direct and reflected rays becomes smaller as each component becomes equal in magnitude but opposite in phase. In the shadow region, the fields are nonexistent.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A bent plate antenna, comprising:

a mounting base having a flat surface portion and a vertical portion, said vertical portion perpendicular to said flat surface portion to define a vertical plane;

a base plate attached to the vertical plane of said vertical portion of said mounting base;

a first arm with a first section integral to and extending at a proximal end from said base plate in the vertical plane and with said first section having a distal end and said first arm integral to a second section having a proximal end connected to the distal end of said first section with said second section extending orthogonal from the distal end of said first section in the vertical plane, and said first arm integral to a third section extending linearly from a distal end of said second section, said third section being bent at an angle out of the vertical plane;

a second arm with a first section integral to and extending at a proximal end from said base plate in the vertical plane and with said first section having a distal end and said second arm integral to a second section having a proximal end connected to the distal end of said first section and extending angularly from the distal end of said first section in the vertical plane, and said second arm integral to a third section extending linearly from a distal end of said second section, said third section being bent at an angle out of said vertical plane;

a connector port fastened to said mounting base; and a stem connecting said base plate to said connector port.

2. The bent plate antenna in accordance with claim 1, further comprising an insulating spacer attached to the vertical portion of said mounting base and said base plate.

3. The bent plate antenna in accordance with claim 2, wherein a material of said insulating spacer is a polymer.

4. The bent plate antenna in accordance with claim 3, wherein said connector port is a coaxial connector having an insulated center pin.

5. The bent plate antenna in accordance with claim 4, wherein said stem is a conductive material.

6. The bent plate antenna in accordance with claim 5, said mounting base being connected to a ground plane.

7. The bent plate antenna in accordance with claim 1, wherein said third section of said first arm and said third section of said second arm are bent in opposite directions out of said vertical plane.

8. An antenna for providing maximum gain at a desired frequency, $f_0$, dimensioned according to an associated wavelength, $\lambda_0$, said antenna comprising:

a mounting base having a flat surface portion and a vertical portion, said vertical portion perpendicular to said flat surface portion to define a vertical plane, said vertical portion having a first section and a second section, each of said first section and a second section having a vertical height of approximately $0.05\lambda_0$ and a width of approximately $0.05\lambda_0$, and said first section being laterally spaced from said second section by approximately $0.05\lambda_0$;

an insulating spacer attached to the vertical portion of said mounting base;

a base plate attached to the insulating spacer, said insulating spacer spacing said base plate from said vertical portion of said mounting base by approximately $0.01\lambda_0$, said base plate having a thickness of approximately $0.005\lambda_0$, a length of approximately $0.19\lambda_0$, and a width of approximately $0.07\lambda_0$;

a first arm with a first section integral to and extending at a proximal end from said base plate in the vertical plane, said first section having a thickness of approximately $0.005\lambda_0$, a length of approximately $0.14\lambda_0$, and a width of approximately $0.07\lambda_0$, and with said first section having a distal end and said first arm integral to a second section having a proximal end connected to the distal end of said first section with said second section extending orthogonal from the distal end of said first section in the vertical plane, said second section having a thickness of approximately $0.005\lambda_0$, a length of approximately $0.05\lambda_0$, and a width of approximately $0.07\lambda_0$, and said first arm integral to a third section extending linearly from a distal end of said second section, said third section having a thickness of approximately $0.005\lambda_0$, a length of approximately $0.22\lambda_0$, and a width of approximately $0.07\lambda_0$, said third section being bent at a 45° angle out of the vertical plane;

a second arm with a first section integral to and extending at a proximal end from said base plate in the vertical plane, said first section having a thickness of approximately $0.005\lambda_0$, a length of approximately $0.17\lambda_0$, and a width of approximately $0.07\lambda_0$, and with said first section having a distal end and said second arm integral to a second section having a proximal end connected to the distal end of said first section and extending at a 45° angle from the distal end of said first section in the vertical plane, said second section having a thickness of approximately $0.005\lambda_0$, a length of approximately $0.08\lambda_0$, and a width of approximately $0.07\lambda_0$, and said second arm integral to a third section extending linearly from a distal end of said second section, said third section having a thickness of approximately $0.005\lambda_0$, a length of approximately $0.22\lambda_0$, and a width of approximately $0.07\lambda_0$, said third section being bent at a 45° angle out of said vertical plane, wherein said third section of said second arm is bent in an opposite direction from said third section of said first arm out of said vertical plane;

a connector port fastened to said mounting base; and a stem connecting said base plate to said connector port.

9. The bent plate antenna in accordance with claim 8, wherein a material of said insulating spacer is a polymer.

10. The bent plate antenna in accordance with claim 8, wherein said connector port is a coaxial connector having an insulated center pin.

11. The bent plate antenna in accordance with claim 8, wherein said stem is a conductive material.

12. The bent plate antenna in accordance with claim 8, said mounting base being connected to a ground plane.

* * * * *